US006988955B2

(12) United States Patent
Stoakes

(10) Patent No.: US 6,988,955 B2
(45) Date of Patent: Jan. 24, 2006

(54) GOLF PUTTER

(76) Inventor: Norman L. Stoakes, 10708 S. 149th St., Omaha, NE (US) 68138

( * ) Notice: Subject to any disclaimer, the term of this patent is extended or adjusted under 35 U.S.C. 154(b) by 11 days.

(21) Appl. No.: 10/700,942

(22) Filed: Oct. 31, 2003

(65) Prior Publication Data

US 2005/0096153 A1 May 5, 2005

(51) Int. Cl.
*A63B 69/36* (2006.01)
*A63B 53/04* (2006.01)

(52) U.S. Cl. ..... 473/242; 473/251; 473/252; 473/334; 473/339; 473/340

(58) Field of Classification Search ..... 473/251–256, 473/334–339, 313, 340–341, 242, 249; D21/736–746, D21/751, 759
See application file for complete search history.

(56) References Cited

U.S. PATENT DOCUMENTS 1,485,272 A * 2/1924 Kinsman ..... 473/242
2,003,951 A * 6/1935 Pepin ..... 473/242
2,517,245 A * 8/1950 Scott ..... 473/339
3,319,962 A * 5/1967 Summers ..... 473/251
D256,262 S * 8/1980 Benson ..... D21/745
4,688,798 A * 8/1987 Pelz ..... 473/249
D312,858 S * 12/1990 Anderson et al. ..... D21/746
5,080,365 A * 1/1992 Winchell ..... 473/255
5,324,031 A * 6/1994 Green ..... 473/252
5,385,348 A * 1/1995 Wargo ..... 473/338
6,561,918 B2 * 5/2003 Kim ..... 473/242
6,716,110 B1 * 4/2004 Ballow ..... 473/242
6,739,980 B2 * 5/2004 Scott et al. ..... 473/200

* cited by examiner

*Primary Examiner*—Sebastiano Passaniti
(74) *Attorney, Agent, or Firm*—Adam H. Jacobs

(57) ABSTRACT

The present invention provides an improved golf putter for increasing alignment and feel in the putting stroke which includes a club head having a body and a forward ball striking surface and a club shaft having a handle, the shaft connected to and extending upwards from the body of the club head. A weight-receiving pocket is formed in an upper surface of the body of the club head and a weight mounting device such as a screw is mounted within the weight-receiving pocket in the body of the club head. At least one club head weight is removably mounted within the weight-receiving pocket of the body of the club head by engagement with the weight mounting device, the club head weight including club head alignment indicia on the top face of club head weight operative to provide visual alignment cues for ball striking by the forward ball striking surface.

9 Claims, 3 Drawing Sheets

GOLF PUTTER

BACKGROUND OF THE INVENTION

1. Technical Field

The present invention relates to golf clubs and, more particularly, to an improved golf putter having a club head with a body and a forward ball striking surface, the body including a weight-receiving pocket formed in an upper surface of the body with a weight mounting device mounted within the weight-receiving pocket, and at least one club head weight removably mounted within the weight-receiving pocket of the body of the club head by the weight mounting device, the club head weight including club head alignment indicia on the top face of the club head weight operative to provide visual alignment cues for ball striking, thereby increasing ball alignment and feel in the putting stroke.

2. Description of the Prior Art

It is well known that, to improve one's golf game, one must become more proficient on and around the green, which is commonly referred to as "working on the short game." One of the most critical aspects of the short game is one's proficiency with the putting stroke, which must be mastered in order to fully realize one's potential for improvement. There are hundreds of types of putters which are currently produced, each of which are designed to assist the golfer in improving his or her putting stroke. These include putters with perimeter weighting devices mounted on the head of the putter, putters with extended shafts such as belly putters and many other types of putters too numerous to discuss. However, regardless of the putter used and the player's skill level, putting essentially reduces to two specific elements, proper alignment of the putter and the proper swing speed to impart the appropriate speed to the golf ball. Of course, mastering these two elements requires a lifetime of work and, therefore, any assistance provided by the equipment itself is more than appreciated.

Many different types of putters have been proposed which attempt to provide alignment and feel-improving systems, including such patents as Hamilton, U.S. Pat. No. 5,803,825, which is directed to a putter having an acoustic chamber for assisting in the correct ball striking during the putting stroke, Norman, 3, U.S. Pat. No. 6,638,181, which discloses a golf club putter having a convex complexly contoured ball impact surface and a high bridge that extends lengthwise at the face of the putter to join the heel and toe, and Wu, U.S. Pat. No. 6,533,680, in which the center of gravity of the putter head is shifted behind the striking surface and the weight of the putter head is shifted to both its ends. As can be seen, numerous types of putter heads have been proposed in the prior art in attempts to address and solve the fundamental problem of putter control, yet this problem remains unsolved for many golfers.

It is well known that the weight of the putter head can make a major difference in the smoothness of the putting stroke, which can directly affect the ability of the golfer to make putts. However, the appropriate head weight for the putter should generally be determined on an individual basis, as it is clear that a 28-year old professional golfer and a 70-year old grandmother should not and would not have the same putter club head weight. There is therefore a need for an easy to use system in which the weight of the putter head may be modified or changed according to the desires, strength and skill level of the golfer, or even according to the golf course conditions and green speed.

Another desirable feature for a putter is to include various types of alignment indicia on the putter to assist in the alignment of the putter with the golf ball and desired direction of the putting stroke. There are numerous types of alignment indicia which are found in the prior art, but one of the main problems with those alignment indicia is that once they are printed on the surface of the putter head, the indicia cannot be changed or modified. Just as is the case with the weight of the putter head, the alignment indicia desired by various golfers may differ, and therefore there is a need for an easily changeable alignment indicia system which permits rapid and efficient substitution of the alignment indicia on the golf club head.

Therefore, an object of the present invention is to provide an improved golf putter.

Another object of the present invention is to provide an improved golf putter for increasing alignment and feel in the putting stroke, which includes a club head having a body and a forward ball striking surface, the club head having a weight-receiving pocket formed in an upper surface thereof with at least one club head weight removably mounted within the weight-receiving pocket, the club head weight including club head alignment indicia on the top face thereof to provide visual alignment cures for ball striking.

Another object of the present invention is to provide an improved golf putter in which the club head weights have different weights and would also include variations in heel and toe weight distribution to provide the golfer with maximum controllability of the putter head via the use of selected weight designs.

Another object of the present invention is to provide an improved golf putter in which various club head weights include various club head alignment indicia, including circles, lines, and arrows, for example, so that the golfer may use the desired alignment indicia with his or her putter head.

Another object of the present invention is to provide an improved golf putter in which the club head weight is quickly and easily removable and replaceable to permit the golfer to make adjustments to the putter head weight and alignment indicia thereon.

Another object of the present invention is to provide an improved golf putter which is U.S.G.A. approved.

Finally, an object of the present invention is to provide an improved golf putter which is relatively simple and inexpensive to manufacture and is safe, efficient, and durable in use.

SUMMARY OF THE INVENTION

The present invention provides a golf putter for increasing alignment and feel in the putting stroke which includes a club head having a body and a forward ball striking surface and a club shaft having a handle, the shaft connected to and extending upwards from the body of the club head. A weight-receiving pocket is formed in an upper surface of the body of the club head and a weight mounting device such as a screw is mounted within the weight-receiving pocket in the body of the club head. At least one club head weight is removably mounted within the weight-receiving pocket of the body of the club head by engagement with the weight mounting device, the club head weight including club head alignment indicia on the top face of club head weight operative to provide visual alignment cues for ball striking by the forward ball striking surface.

The improved golf putter of the present invention provides several advantages over those devices found in the prior art. For example, the golfer using the present invention may quickly and easily swap out club head weights to achieve a desired head weight, thus enabling the golfer to adjust the club head weight to adjust his or her swing to various putting conditions. Also, because the alignment indicia on the top of the club head weight may be modified or changed by merely substituting a different club head weight, the individual indicia desires of the golfer may be quickly and easily accommodated. Furthermore, because the club head weight of the present invention is generally longitudinally extended, adjustments between the heel and toe weight of the putter head may be quickly and easily made by merely substituting the appropriately weighted club head weight into the weight-receiving pocket. Finally, the relatively simple weight mounting system provided by the present invention means that the present invention is usable by golfers of all skill levels, thus enhancing their enjoyment of the game. It is thus seen that the improved golf putter of the present invention provides several substantial improvements over those devices found in the prior art.

DESCRIPTION OF THE PREFERRED EMBODIMENT

The improved golf putter 10 of the present invention is shown best in FIGS. 1–4*c* as including a club head 12, a club shaft 40 extending upwards from and connected to the club head 12 and a handle grip 42 mounted on the upper end of the club shaft 40. The inventive elements of the present invention reside within the club head 12, however, and it is to this area that the focus of the present disclosure will be directed.

Figure 1:
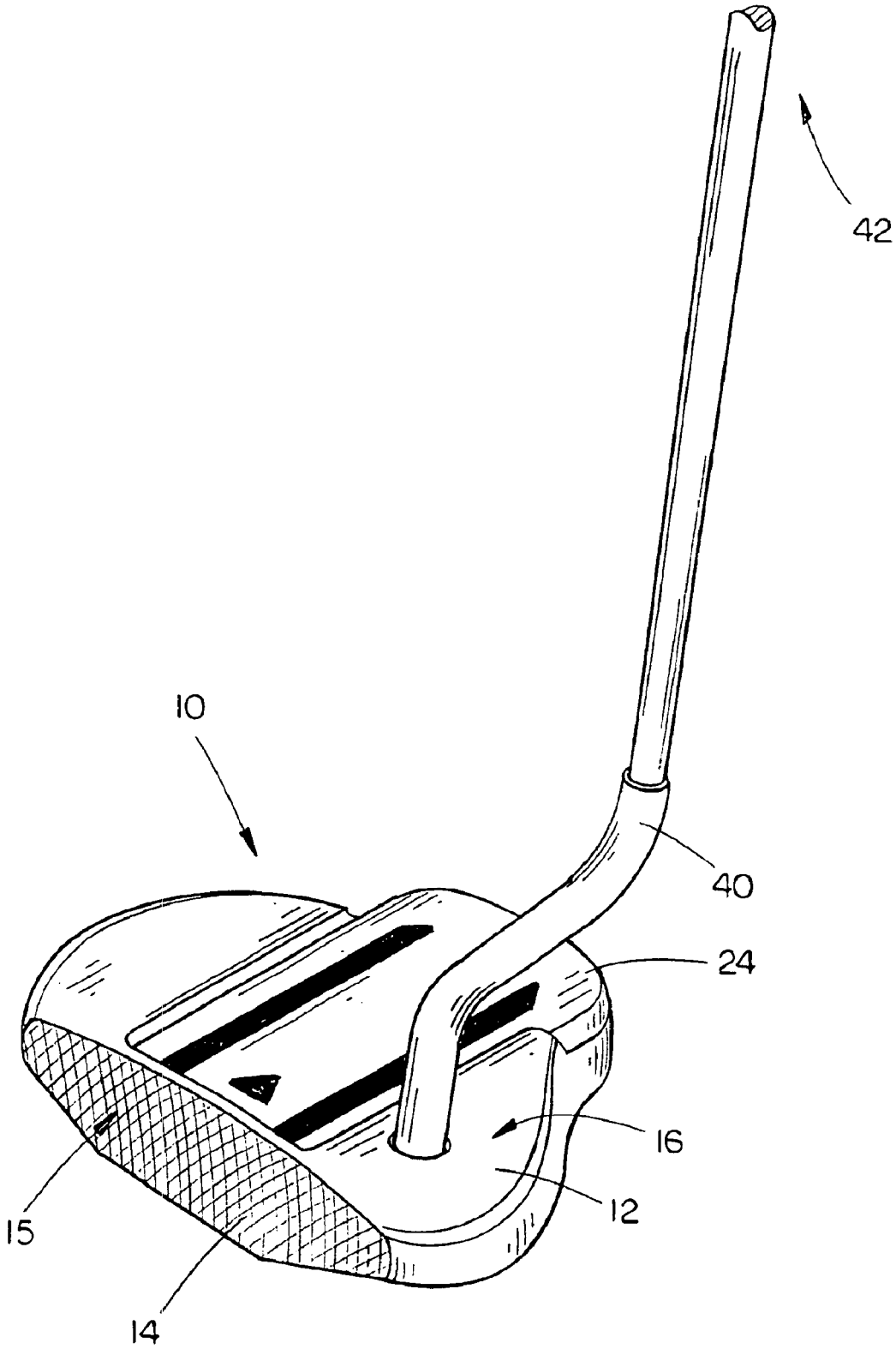
FIG. 1 is a perspective view of the improved golf putter of the present invention.
Figure 2:
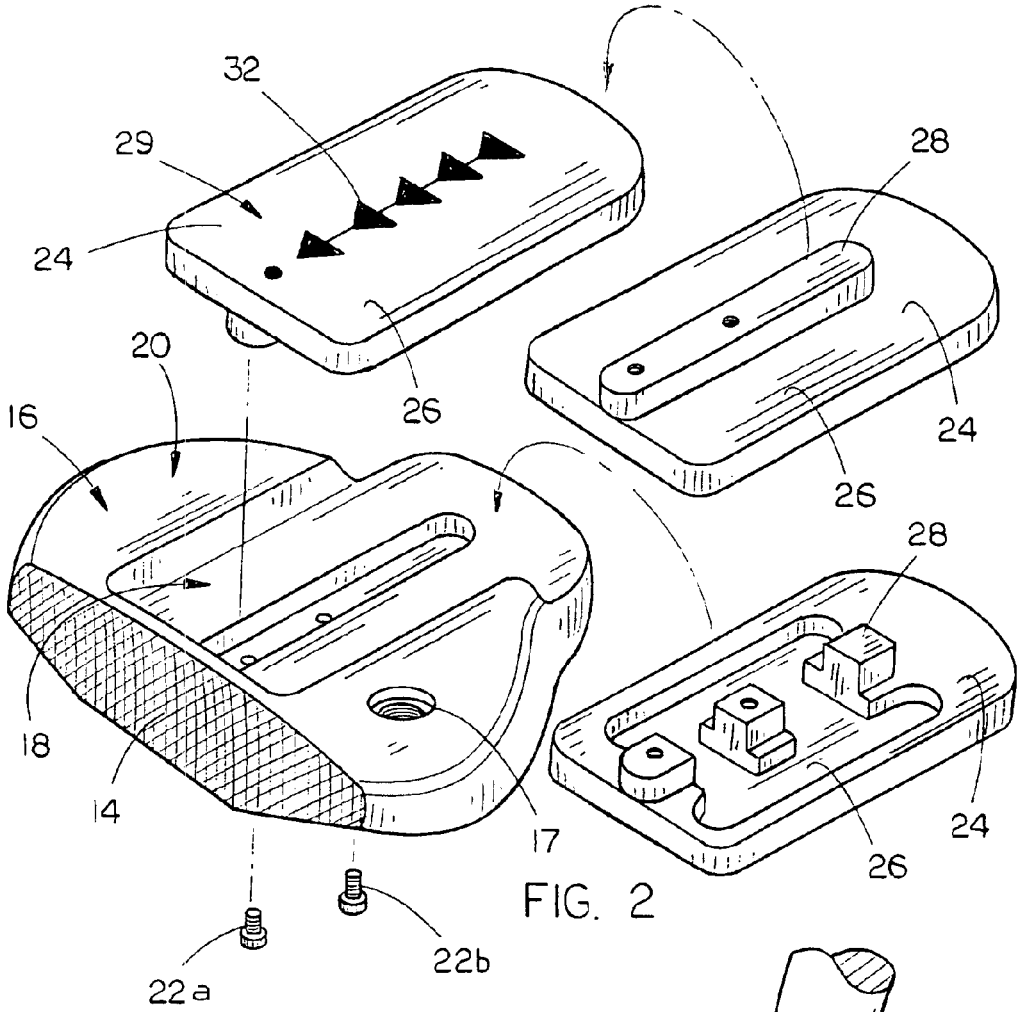
FIG. 2 is a detail exploded perspective view of the improved golf putter of the present invention.
Figure 3:
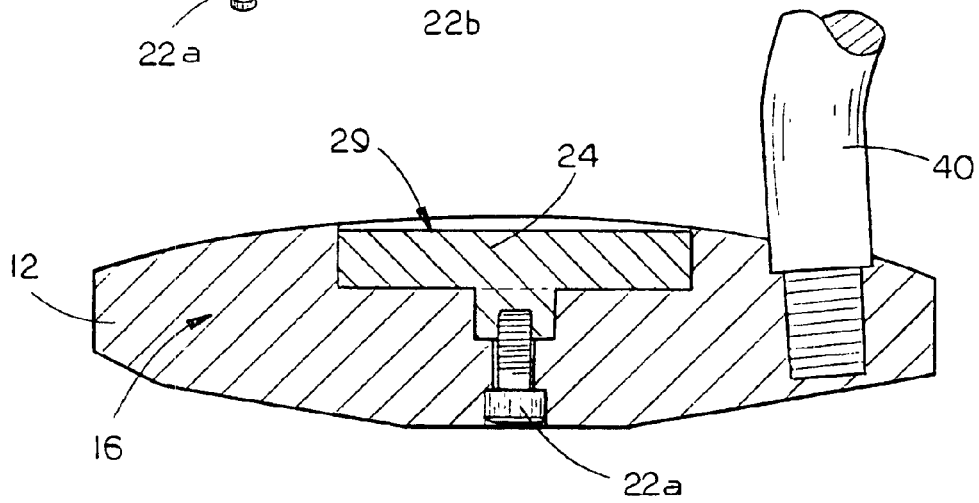
FIG. 3 is a front sectional elevational view of the improved golf putter of the present invention showing the club head weight mounted within the weight-receiving pocket.

Club head 12 would include a forward ball striking surface 14 and a body 16 situated behind the forward ball striking surface 14, as shown best in FIGS. 2 and 3. The forward ball striking surface 14 may have a milled face 15 which is milled in a particular pattern and is formed in the surface thereof to increase the frictional contact of the forward ball striking surface 14 with the golf ball, although the exact pattern and shape of the forward ball striking surface 14 may be modified or changed depending on the desires of the user of the present invention. It is further preferred that the body 16 be constructed of a metal such as aluminum, brass, copper, or any other appropriate metal as determined by the manufacturer and/or user of the present invention, and further it should be noted that the body 16 may be manufactured in various ways, including via casting, milling or any other appropriate metal body construction technique.

The body 16 of club head 12 is preferably generally trapezoidal in shape with rounded edges to increase the aesthetic appearance of the club head 12. In the preferred embodiment, the club head 12 would have a height of approximately one-half inch to one inch, a width of approximately three to six inches, and a length of approximately two to five inches, depending on the desires of the user of the present invention and the specific head size restrictions as mandated by the U.S.G.A.

As shown best in FIGS. 2 and 3, body 16 of club head 12 would further include a threaded shaft hole 17, a weight-receiving pocket 18 formed in the upper surface 20 of body 16 of club head 12. It is preferred that the weight-receiving pocket 18 be generally rectangular in shape and extend from adjacent the forward ball striking surface 14 rearwards along the central axis of the body 16 of club head 12 to the rear of the body 16, as shown best in FIG. 2. It should be noted, however, that the precise size and shape of the weight-receiving pocket 18 is not critical to the present invention so long as the weight-receiving pocket 18 is centered on body 16 to prevent lateral disruption of the center of gravity of body 16 of club head 12, and the manner of construction of the weight-receiving pocket 18 will generally correspond to the method of construction of the body 16 itself.

Mounted within weight-receiving pocket 18 adjacent the base thereof and extending through the underside of body 16 of club head 12 are a pair of weight mounting screws 22*a* and 22*b* which, in the preferred embodiment, would extend upwards from the base of weight-receiving pocket 18 into the weight-receiving pocket 18 for releasably securing a club head weight within the weight-receiving pocket 18. The functionality of the weight mounting screws 22*a* and 22*b* will be described later in connection with the club head weight.

The club head weight 24 of the present invention is shown best in FIGS. 1–4*c* as including a generally flat top plate 26 and a weight mounting screw engagement bar 28 mounted on the underside of top plate 26 and depending downwards therefrom. It is preferred that the top plate 26 have approximately the same dimensions in width and length as weight-receiving pocket 18 so that when the club head weight 24 is placed within weight-receiving pocket 18, top plate 26 is generally aligned with upper surface 20 of body 16 to create a generally smooth surface having a good aesthetic appearance which will also prevent the incursion of foreign objects into the weight-receiving pocket 18. Additionally, the upper surface 29 of the top plate 26 may be contoured to correspond to the upper surface 20 of the body 16 of club head 12, although this is not critical to the functionality of the invention, merely to the aesthetic appearance of the invention. It is further preferred that the weight mounting screw engagement bar 28 of club head weight 24 include a pair of threaded screw holes 30*a* and 30*b* into which the weight mounting screws 22*a* and 22*b* can be extended to releasably secure the club head weight 24 within weight-receiving pocket 18. Of course, it should be noted that other types of weight mounting systems may be used with the present invention, such as snap-lock devices and other such mounting devices, any of which would be understood by those skilled in the art of metal connection and securement devices.

Figure 4A:
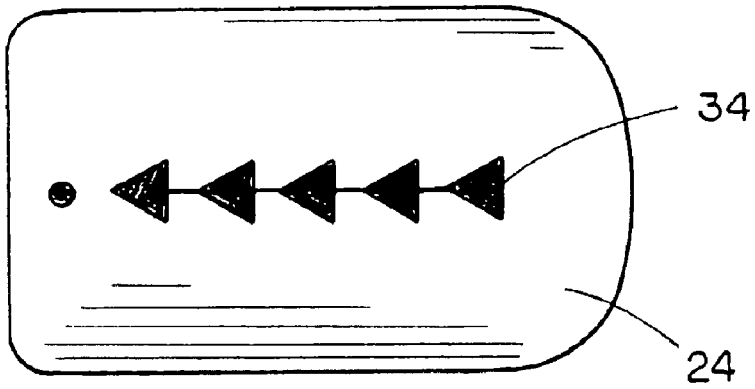
FIGS. 4*a*, 4*b* and 4*c* are detail top plan views of various alignment indicia printed on the top surface of the club head weight.
Figure 4B:
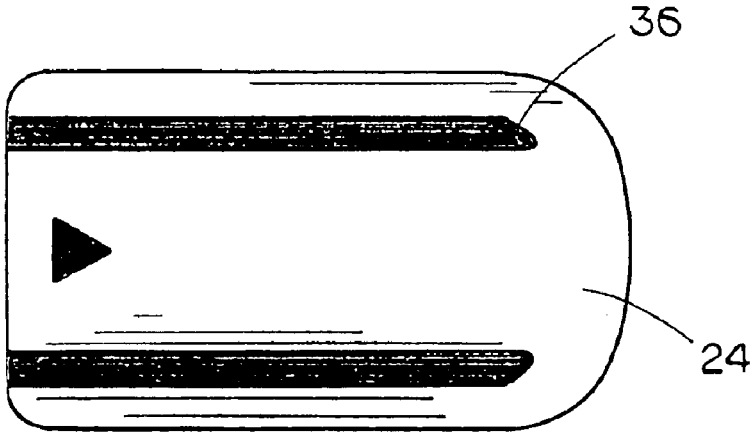
Figure 4C:
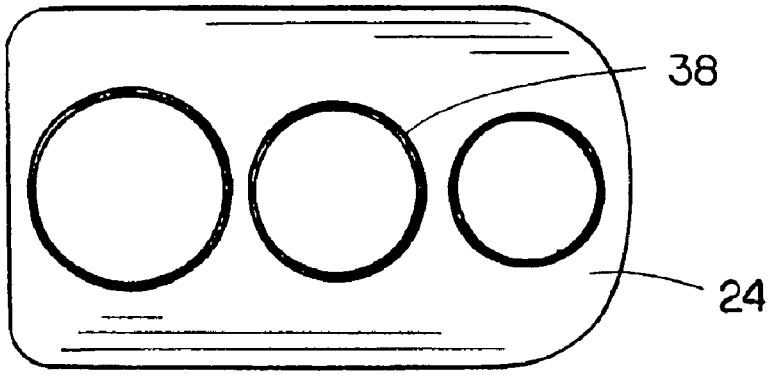

Printed or affixed on the upper surface 29 of top plate 26 of club head weight 24 is a club head alignment indicia 32 which will assist the user of the present invention in aligning the club head 12 of the improved golf putter 10 with the golf ball to be struck. The club head alignment indicia 32 may take various forms, such as linked arrows 34, parallel lines 36, or even a series of alignment circles 38, as shown in FIGS. 4*a*, 4*b* and 4*c*, any of which may be used to properly align the club head 12 of the improved golf putter 10 with the golf ball to be struck. The precise and specific club head alignment indicia 32 used with the present invention may be modified or changed, however, depending on the desires of the user of the present invention, but in any case it is intended and required that the club head alignment indicia 32 be printed or affixed to the upper surface 29 of top plate 26 such that when club head weight 24 is positioned within weight-receiving pocket 18, the club head alignment indicia 32 is aligned with the forward ball striking surface 14 to permit proper alignment of the club head 12 with the golf ball to be struck.

The improved golf putter 10 of the present invention thus provides many advantages over those devices found in the prior art. Specifically, the club head weight 24 may be made of various weight and may further include additional toe weight or additional heel weight to modify the feel of the club head 12 to accommodate individual play characteristics of the golfer, although it has been found that back weighting generally keeps the golf ball rolling truer than other types of weighting due to the improved contact characteristics upon the forward ball striking surface 14 impacting the golf ball. For instance, it has been found that club head weights 24 varying between 300 and 500 grams in weight provide accurate and desirable adjustment of the weight of the club head 12, although variations in the specific weights used are contemplated for use with the present invention. Furthermore, the club head weight 24 may be of varying weights to accommodate differing green speeds. For example, a player playing golf at a country club such as Olympia Fields in Chicago, site of the 2003 U.S. Open, would encounter very fast greens which would require decreased putter club head weight, whereas the same golfer playing on a municipal course in his or her hometown would encounter far slower green speeds which would require increased club head weight to maintain swing characteristics. Just as importantly, the club head alignment indicia 32 printed on the top plate 26 of club head weight 24 may be modified or changed, depending upon which alignment indicia provides the greatest confidence to the player using the improved golf putter 10 of the present invention. For example, one player may desire to use the linked arrows 34 as shown in FIG. 4*a* to show the precise alignment of the center of the club with the golf ball, whereas another player may desire to use the depending circle design 38 as shown in FIG. 4*c* which provides better visual alignment cues for that individual. Finally, because the weight mounting screws 22*a* and 22*b* may be quickly and easily inserted and removed from the weight mounting screw engagement bar 28 of club head weight 24, the club head weight 24 used with the present invention may be swapped out in a very small amount of time to permit the user of the present invention to quickly adapt to changing golfing conditions, a feature not found in any of the devices shown in the prior art.

It is to be understood that numerous additions, substitutions, and modifications may be made to the improved golf putter 10 of the present invention which fall within the intended broad scope of the appended claims. For example, the precise size, shape, and construction materials used in connection with the club head 12 and club head weight 24 may be modified or changed, depending on the performance characteristics desired by the user of the present invention. Furthermore, the club head alignment indicia 32 may be modified or changed to accommodate many different types of indicia, depending on the needs and desires of the user. Finally, the weight mounting device 22*a* and 22*b* and weight-receiving pocket 18 may be modified in both design and size to accommodate various other types of weights to be used with the present invention, so long as the weight being used includes club head alignment indicia printed on the top surface thereof for alignment of the golf club with the golf ball to be struck.

There has therefore been shown and described an improved golf putter 10 which accomplishes at least all of its intended objectives.

I claim:

1. An improved golf putter for increasing alignment and feel in the putting stroke comprising:

a club head having a body and a forward ball striking surface;

a club shaft connected to and extending upwards from said body of said club head, said club shaft further including a handle on the upper end thereof;

a weight-receiving pocket formed in an upper surface of said body of said club head;

weight mounting means mounted within said weight-receiving pocket in said body of said club head;

at least one club head weight removably mounted within said weight-receiving pocket of said body of said club head by engagement with said weight mounting means, said at least one club head weight including a generally flat top plate and a weight mounting means engagement portion mounted on the underside of said top plate and depending downwards therefrom, said top plate of said at least one club head weight having approximately the same length and width dimensions as said weight-receiving pocket such that when said at least one club head weight is placed within said weight-receiving pocket, said top plate is generally aligned with the upper surface of said body of said club head to create a generally smooth surface having a good aesthetic appearance which will also generally prevent the incursion of foreign objects into said weight-receiving pocket;

said at least one club head weight including club head alignment indicia on the top face of said at least one club head weight operative to provide visual alignment cues for ball striking by said forward ball striking surface.

2. The improved golf putter of claim 1 wherein said club head is generally trapezoidal in shape.

3. The improved golf putter of claim 2 wherein said weight-receiving pocket is generally rectangular in shape and is generally aligned with the center longitudinal axis of said body of said club head.

4. The improved golf putter of claim 1 wherein said at least one club head weight has a weight between 100 and 600 grams.

5. The improved golf putter of claim 1 wherein said club head alignment indicia comprises linked arrows generally aligned with the center longitudinal axis of said body of said club head.

6. The improved golf putter of claim 1 wherein said club head alignment indicia comprises at least two parallel lines generally aligned with the center longitudinal axis of said body of said club head.

7. The improved golf putter of claim 1 wherein said club head alignment indicia comprises at least two depending circles generally aligned with the center longitudinal axis of said body of said club head.

8. An improved golf putter for increasing alignment and feel in the putting stroke comprising:

a club head having a body and a forward ball striking surface;

a club shaft connected to and extending upwards from said body of said club head, said club shaft further including a handle on the upper end thereof;

a weight-receiving pocket formed in an upper surface of said body of said club head;

weight mounting means mounted within said weight-receiving pocket in said body of said club head;

at least two club head weights having differing weight, each operative to be removably mounted within said weight-receiving pocket of said body of said club head by engagement with said weight mounting means such that the total weight of said club head is adjustable, said at least two club head weights each including a top plate and a weight mounting means engagement portion mounted on the underside of said top plate and depending downwards therefrom, said top plate of each of said at least two club head weights having approximately the same length and width dimensions as said weight-receiving pocket such that when each of said at least two club head weights is placed within said weight-receiving pocket, said top plate is generally aligned with the upper surface of said body of said club head and is operative to generally prevent the incursion of foreign objects into said weight-receiving pocket;

each of said at least two club head weights including club head alignment indicia on the top face of said at least two club head weights operative to provide visual alignment cues for ball striking by said forward ball striking surface.

9. An improved golf putter for increasing alignment and feel in the putting stroke comprising:

a club head having a body and a forward ball striking surface;

a club shaft connected to and extending upwards from said body of said club head, said club shaft further including a handle on the upper end thereof;

a weight-receiving pocket formed in an upper surface of said body of said club head;

weight mounting means mounted within said weight-receiving pocket in said body of said club head;

at least one club head weight removably mounted within said weight-receiving pocket of said body of said club head by engagement with said weight mounting means;

said weight mounting means including at least one weight mounting screw extending upwards from the base of said weight-receiving pocket into the weight-receiving pocket for releasably securing said club head weight within said weight-receiving pocket; and said at least one club head weight including club head alignment indicia on the top face of said at least one club head weight operative to provide visual alignment cues for ball striking by said forward ball striking surface.

* * * * *